US006113424A

United States Patent [19]

Shinozaki

[11] Patent Number: 6,113,424

[45] Date of Patent: Sep. 5, 2000

[54] ELECTRICAL PANEL CONNECTOR WITH SEAL RETAINING ALIGNMENT PLATE

[75] Inventor: Tetsuya Shinozaki, Yokkaichi, Japan

[73] Assignee: Sumitomo Wiring Systems, Ltd., Japan

[21] Appl. No.: 09/300,274

[22] Filed: Apr. 27, 1999

[30] Foreign Application Priority Data

May 28, 1998 [JP] Japan ..... 10-147715

[51] Int. Cl.[7] ..... H01R 13/73

[52] U.S. Cl. ..... 439/559; 439/556

[58] Field of Search ..... 439/559, 544, 439/552, 556, 275, 620, 271, 79, 80, 76.1; 277/205, 208

[56] References Cited

U.S. PATENT DOCUMENTS 5,158,391 10/1992 Fujitani ..... 403/288

5,266,054 11/1993 Duncan et al. ..... 439/620

5,417,591 5/1995 Demmler ..... 439/620

FOREIGN PATENT DOCUMENTS 3-127783 12/1991 Japan .

*Primary Examiner*—Lincoln Donovan
*Assistant Examiner*—Chandrika Prasad
*Attorney, Agent, or Firm*—Banner & Witcoff, Ltd.

[57] ABSTRACT

A flange protrudes from side faces of a housing of a connector attached to a panel, a waterproofing ring being provided next to the flange. The positioning of terminals passing through the housing is regulated by an alignment plate. One end of the alignment plate faces protrusions on the waterproofing ring from the side opposite the flange, thereby preventing the separation of the waterproofing ring from the flange. According to this invention, the alignment plate for correcting the positioning of the terminals is used to prevent the separation of the waterproofing ring without incurring high production costs, and as a consequence the connector can easily be attached to the panel.

8 Claims, 7 Drawing Sheets

ELECTRICAL PANEL CONNECTOR WITH SEAL RETAINING ALIGNMENT PLATE

TECHNICAL FIELD

The present invention relates to a connector for attachment to a panel.

BACKGROUND OF THE INVENTION

Connectors attached to panels generally have a flange protruding from a side face of a connector housing, the connector being attached by pressing the flange against an opening edge of an attachment hole formed on the panel. In waterproof connectors, the connector is attached with a waterproofing ring between the flange and the panel.

In this type of connector, even when the waterproofing ring has been placed in position in advance, the waterproofing ring still sometimes separates from the flange while the connector is being attached to the panel, and attaching the connector becomes difficult. On the other hand if a waterproofing ring is formed in a unified manner with the flange, as in the connector attached to a panel described in JP-3-127783, production costs are high.

The present invention has been developed after taking the above problem into consideration and aims to present a connector attached to a panel in which production costs are low, and in which attachment to the panel can be performed easily.

SUMMARY OF THE INVENTION

According to the invention there is provided an electrical panel connector assembly for insertion in an aperture of a panel, and comprising a connector housing having a front side, a rear side, a continuous peripheral flange to determine panel insertion depth, and an annular seal adapted to be positioned at said front side against said flange, wherein said connector housing has terminals protruding from the rear side, the free ends of which are bent substantially at right angles, and said assembly further includes an alignment plate attachable to the side of said body and having apertures to receive said free ends, characterised in that said annular seal has an inwardly extending protrusion in the plane thereof, said protrusion being located between said flange and said alignment plate.

Such an arrangement utilises the existing alignment plate to retain the seal, and this provides an inexpensive solution to the problem of seal detachment.

Preferably, the alignment plate includes a projection extending parallel to said flange in the vicinity of said protrusion. This arrangement permits better retention of the seal if the alignment plate is thin.

The protrusion may be continuous or may be multiple. Preferably the protrusion is accommodated between the alignment plate and flange with clearance. This avoids the possibility of seal distortion in certain circumstances.

The seal may be accommodated in a recess of the flange, and preferably has continuous ribs on either side thereof to improve the sealing effect.

BRIEF DESCRIPTION OF THE DRAWINGS

Other features of the invention will be apparent from the following description of a preferred embodiment shown by way of example only in the accompanying drawings, in which.

DESCRIPTION OF PREFERRED EMBODIMENTS

An embodiment of the present invention is explained below with the aid of FIGS. 1 to 7.

Figure 1:
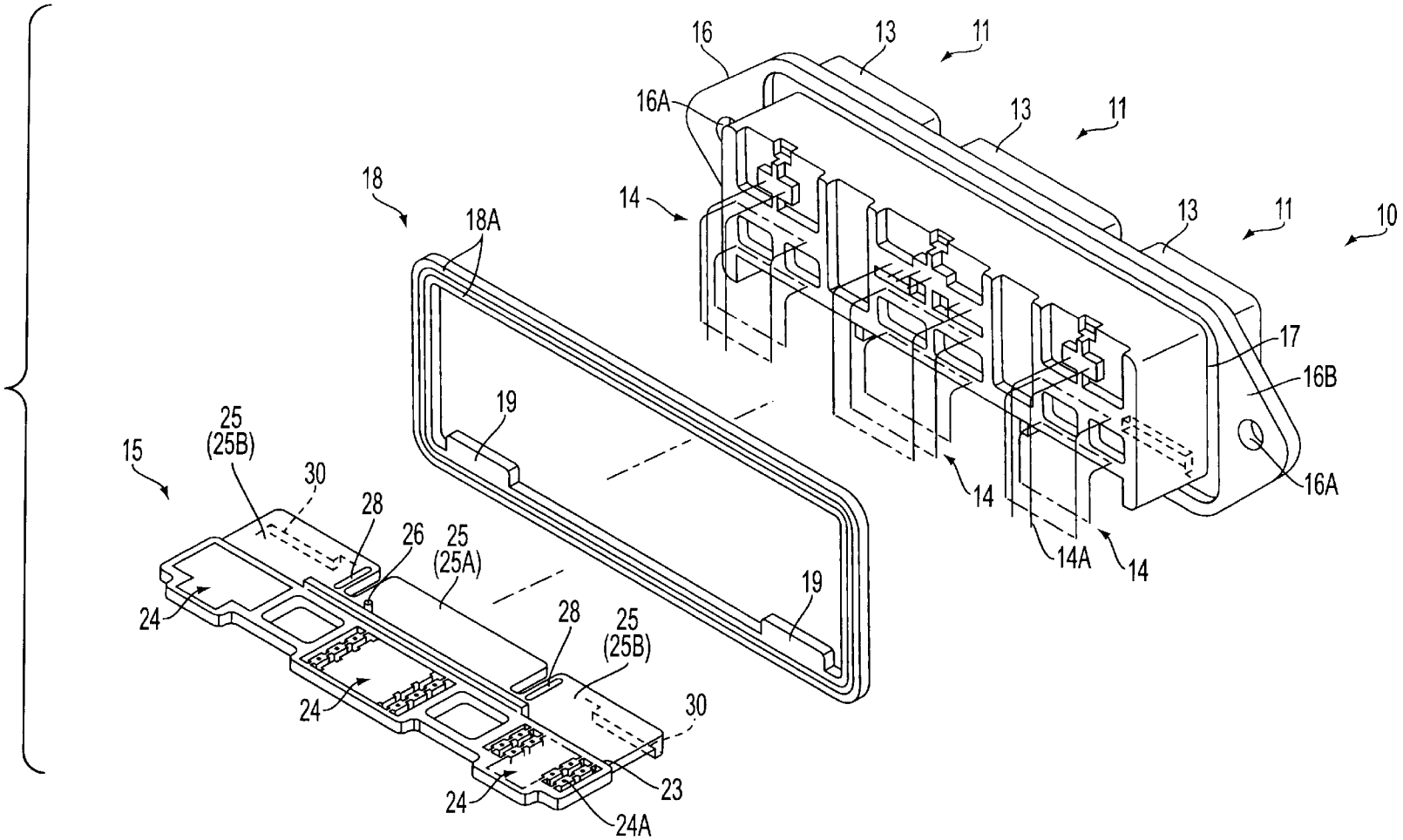
FIG. 1 is a diagonal view showing a connector attached to a panel of an embodiment of the present invention.

As shown in FIG. 1, a connector housing 10 provided in a connector attached to a panel is of an oblong rectangular parallelepiped shape. Three connector members 11 are aligned horizontally inside the housing 10, each of these members 11 being open at the anterior face of the housing 10, these openings forming concave openings 12 (see FIG. 2). An angular tubular hood 13 is provided on opening edges of each opening 12 on the anterior face of the housing 10, corresponding connectors (not shown) being parallel to these hoods 13 and fitting into the openings 12.

Figure 2:
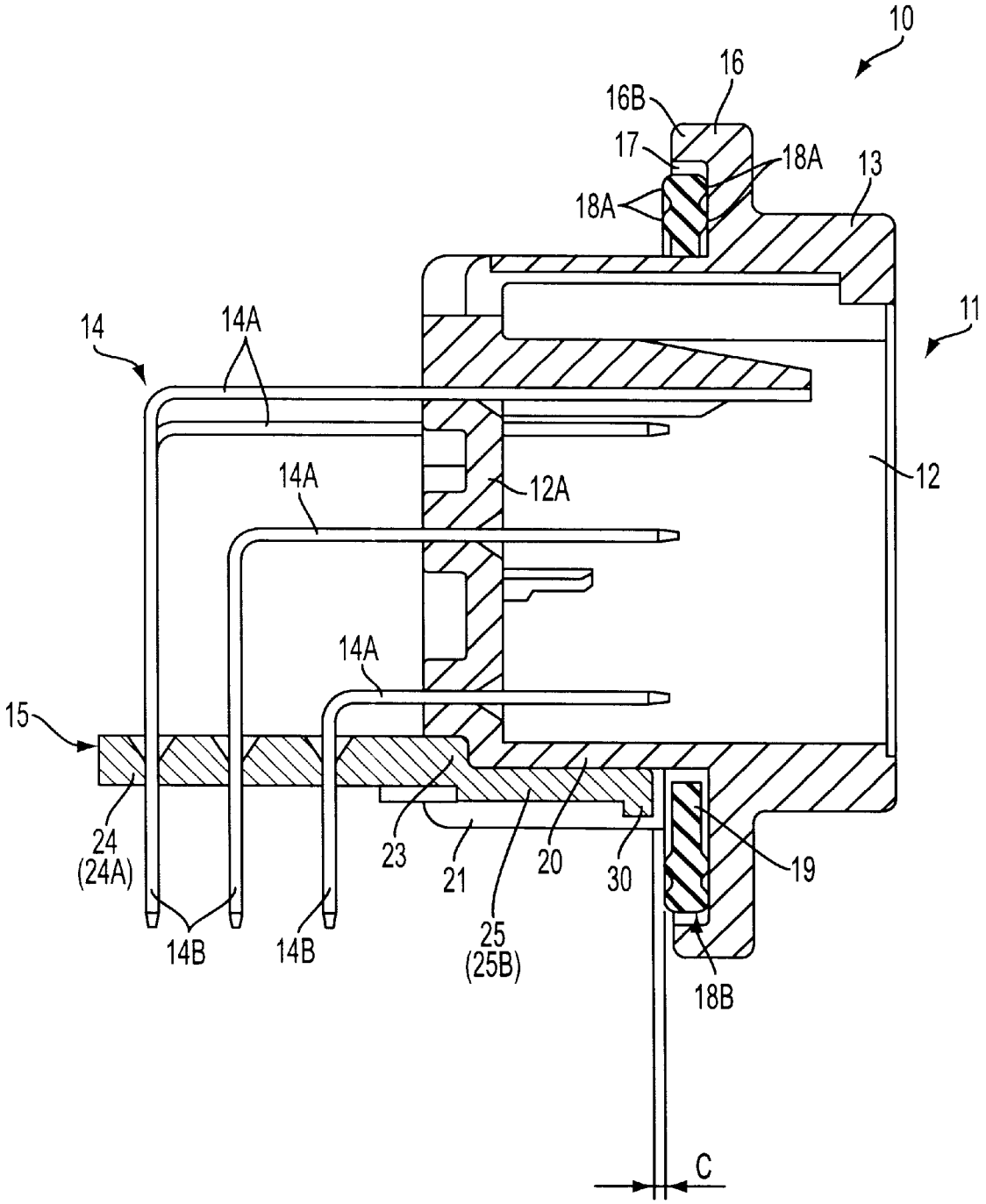
FIG. 2 is a cross-sectional view taken along line II—II in FIG. 6.
Figure 3:
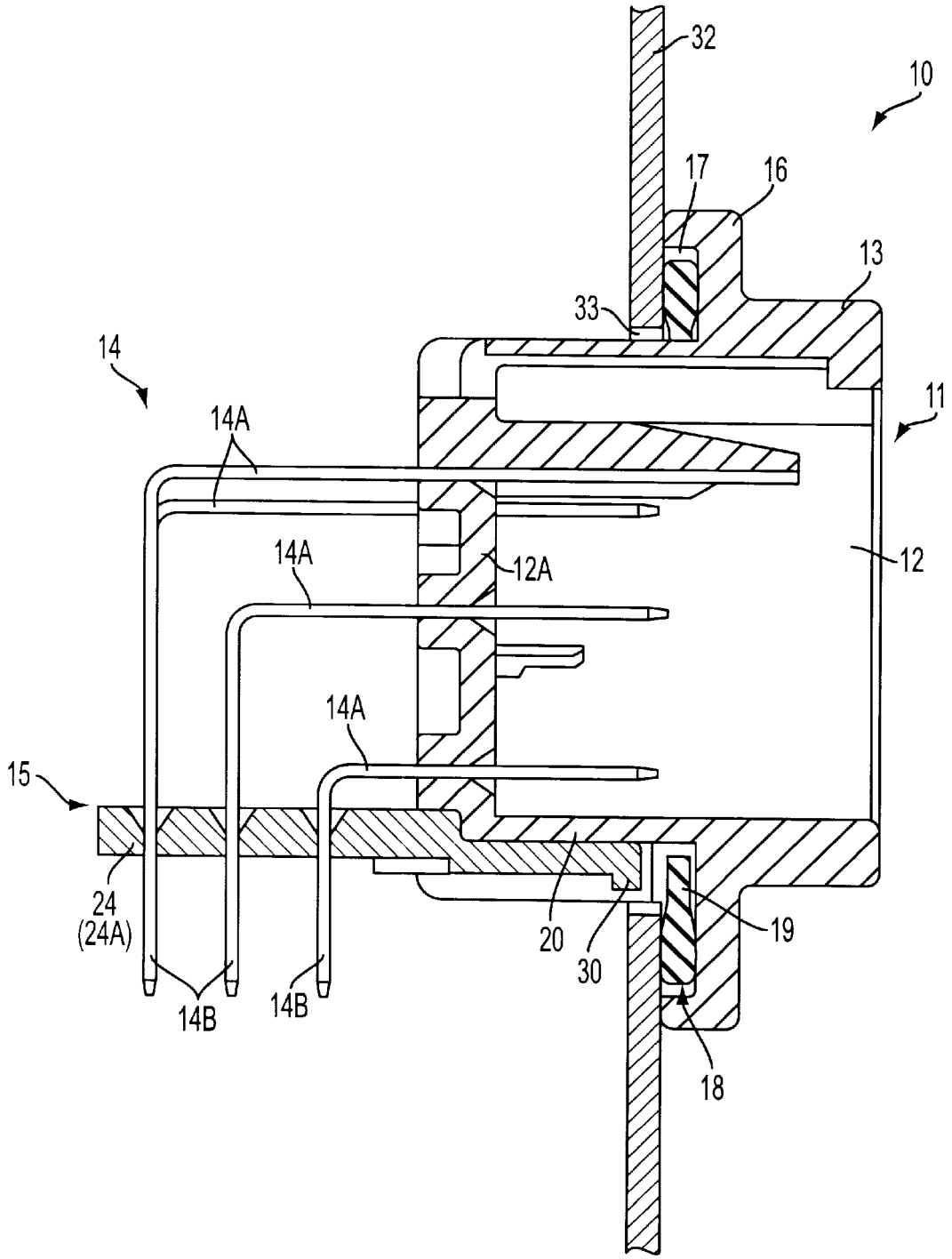
FIG. 3 is a cross-sectional view taken along line II—II in FIG. 6 showing the connector attached to a panel.

A plurality of terminals 14 are provided within each connector member 11 in the housing 10. As shown in FIG. 2, base end terminals 14A of the terminals 14 pass through innermost walls 12A of the opening 12, one end thereof protruding towards the mouths of the openings 12. When the corresponding connectors are fitted into the openings 12, these base end terminals 14A make contact with corresponding terminal fittings housed within the corresponding connectors. Furthermore, the other end of each base end terminal 14*a* is bent at right angles (towards the bottom of FIG. 2) in a mutually parallel manner at the rear face of the housing 10, the tips thereof being aligned vertically in the same position directly behind one another.

A flange 16 protrudes from side faces of the housing 10. The flange 16 protrudes to a uniform height from two of the side faces of the housing 10, these being the upper and lower faces in FIG. 1, and a central portion of each of the two faces facing left and right protrudes further and is of a triangular shape. A through hole 16A is formed in the vicinity of the peak of each triangle.

Figure 4A:
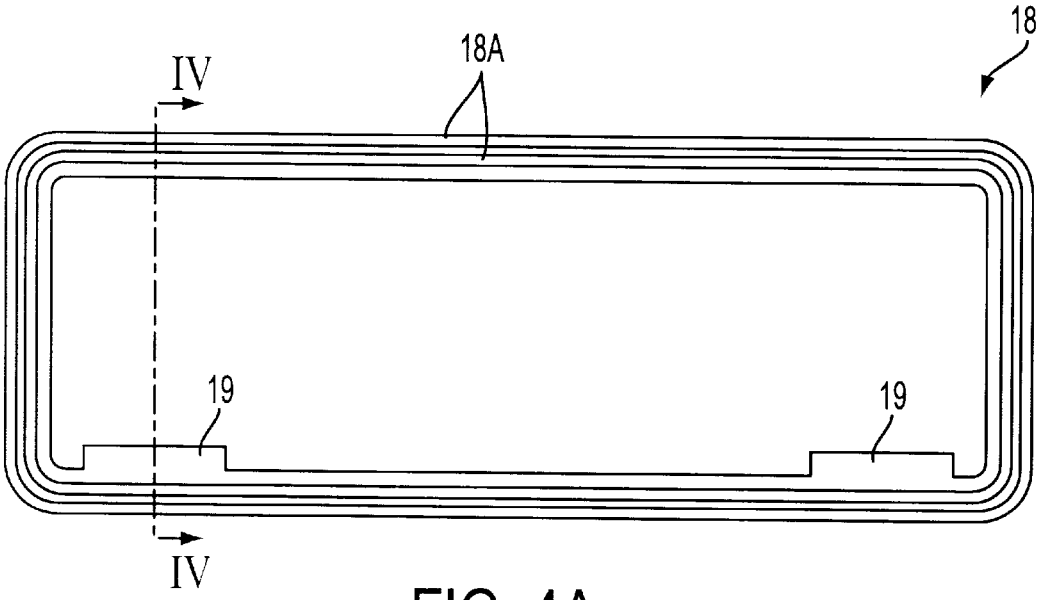
FIG. 4A is a plan view of a sealing ring.
Figure 4B:
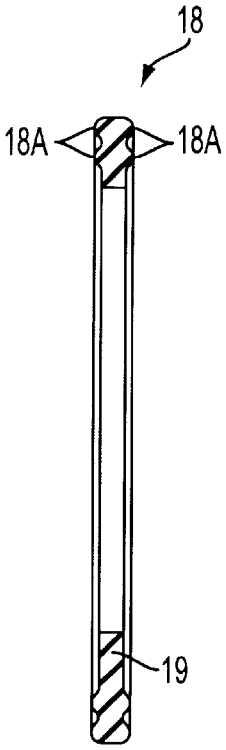
FIG. 4B is a cross sectional view taken along line IV—IV in FIG. 4A.

A housing groove or recess 17 following the direction of the circumference is set into the base end of a rear face 16B of the flange 16. This houses the waterproofing ring or annular seal 18. As shown in FIG. 4, the waterproofing ring 18 has a rectangular frame shape corresponding to the shape of the outer circumference of the housing 10, a pair of protrusions 19 extending inwards from two end portions of one of the longer sides thereof. Moreover, outer and inner faces of the waterproofing ring 18 are each provided with two lips 18A (see FIG. 4(B)), these extending along the direction of the circumference.

Figure 5:
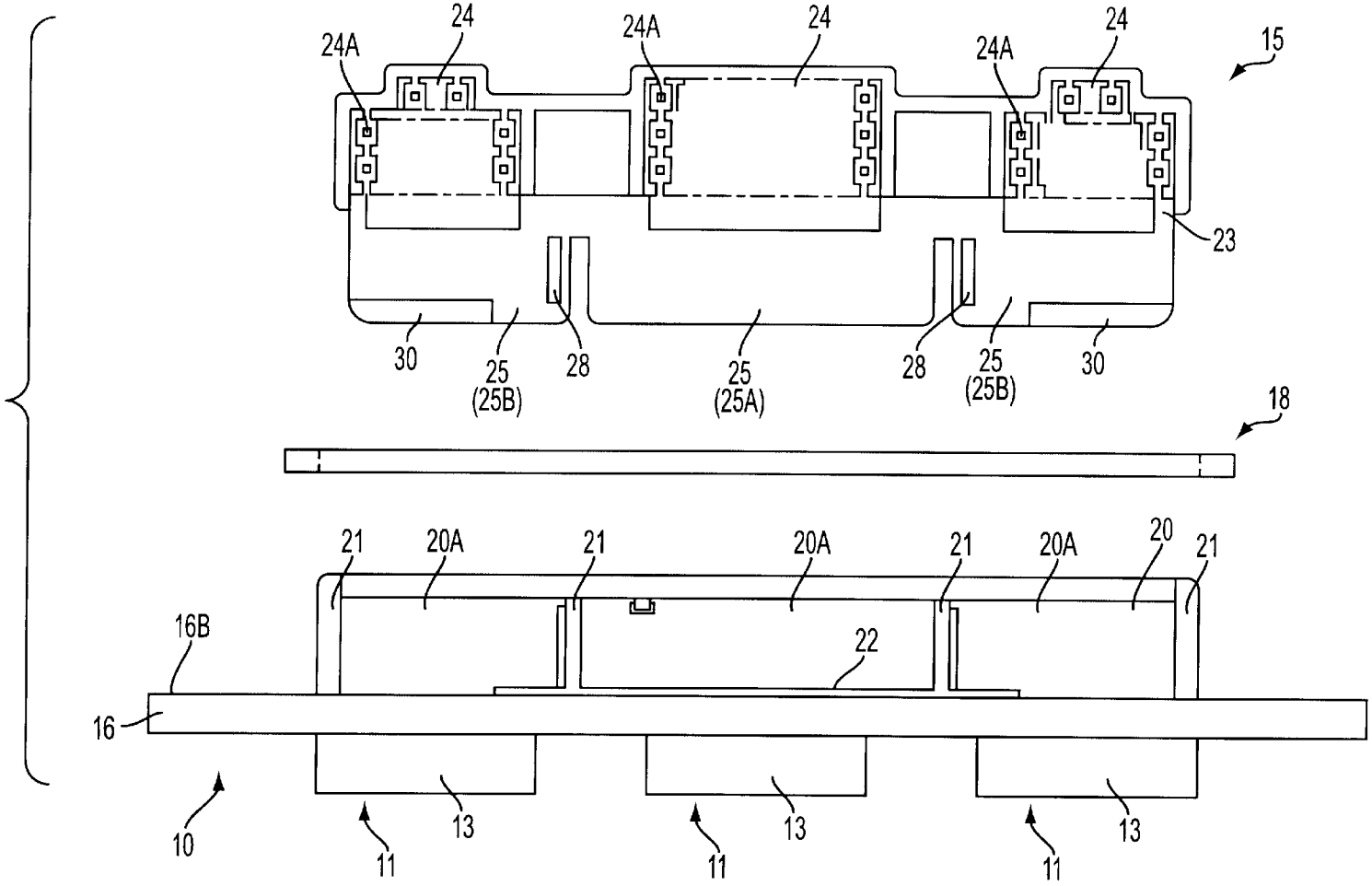
FIG. 5 is a view from below the connector attached to a panel.
Figure 7:
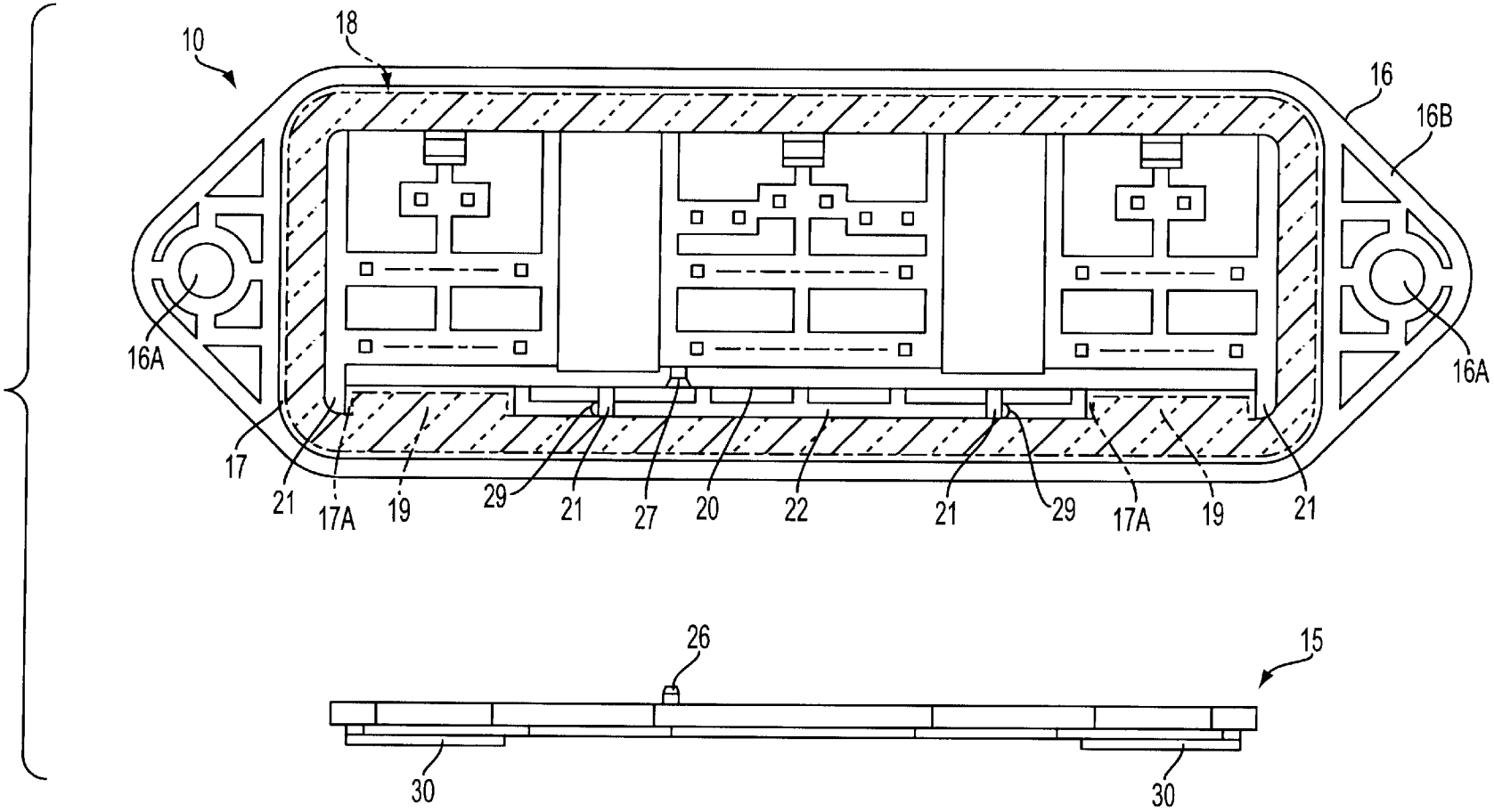
FIG. 7 is a rear face view of the connector attached to a panel.

The side of the housing 10 towards which the tips of the base end terminals 14A extend forms an attachment face 20, an alignment plate 15 being attached thereto. As shown in FIG. 5, four ribs 21 are provided in a horizontal direction on both ends and in the central portion of the attachment face 20. Further, as shown in FIG. 7, a protrusion 22 is provided on the portion of the attachment face 20 which is located within the housing groove 17, this protrusion 22 fixing the position of the waterproofing ring 18. The protrusion 22 extends part way along a horizontal portion of the attachment face 20 and is of the same height as the ribs 21. The inner circumference face of the waterproofing ring 18 between the two protrusions 19 makes contact (from the lower part of FIG. 7) with the protrusion 22, thereby fixing the position of the waterproofing ring 18. Moreover, the protrusions 19 are housed in rectangular areas 17A, these rectangular areas 17A being located between the protrusion 22 and the ribs 21 of the two sides of the attachment face 20 within the housing groove 17.

The alignment plate 15 has an oblong shape corresponding to the housing 10, a step 23 being provided part-way along the anterior-posterior direction of the alignment plate 15 (the horizontal direction in FIG. 2). Three attachment hole groups 24 are provided on the alignment plate 15 at a location posterior to the step 23 (the left side in FIG. 2), and the alignment plate 15 to the anterior of the step 23 is divided horizontally into three installation protrusions 25. As shown in FIG. 2, when the alignment plate 15 is attached to the housing 10, the free ends (14B) of the terminals 14 are passed through each attachment hole 24A of the attachment hole or aperture groups 24, and the installation protrusions 25 are housed between the ribs 21 provided on the attachment face 20 of the housing 10.

As shown in FIG. 1, a position fixing protrusion 26 protrudes upwards from the central installation protrusion 25A on the alignment plate 15, this fitting into a hole 27 provided on the housing 10 (see FIG. 7). Furthermore, as shown in FIG. 1, the installation protrusions 25B on both sides of the central installation protrusion 25A each have rectangular holes 28 extending along the side edge adjacent to the central installation protrusion 25A, and protruding members 29 (see FIG. 7) provided on the ribs 21 of the attachment face 20 cause the side walls of the installation protrusions 25B to change shape on the sides provided with the rectangular holes 28. Moreover, as shown in FIG. 2, a clearance C is provided between the end of the alignment plate 15 and the waterproofing ring 18 in the housing groove 17.

A wall or projection 30 is formed at right angles at the anterior end of each of the two installation protrusions located on the sides, this wall 30 being at a location corresponding to the rectangular areas 17A of the housing groove 17. As shown in FIG. 2, the wall 30 extends parallel to the flange 16 and in a direction away from the attachment face 20.

A panel 32 (see FIG. 3), to which this connector is attached, is provided, for example, on a case of an electrical device, a connector attachment hole 33 being formed on this panel 32. The connector attachment hole 33 is rectangular in shape and corresponds to the shape of the outer circumference of the housing 10, both sides of the connector attachment hole 33 having bolt holes (not shown).

Next, the operation of the present embodiment, configured as described above, will be explained.

The waterproofing ring 18 is attached to the housing 10 as follows: the waterproofing ring 18 is positioned below the housing 10 in FIG. 1, the side of the waterproofing ring 18 provided with the extending protrusions 19 is placed against the flange 16 of the housing 10, and the tips of the base end terminals 14A are inserted through the opening of the waterproofing ring 18. Then the waterproofing ring 18 is raised vertically upwards along the bent portion of the base end terminals 14A and is pushed into the housing groove 17 at the rear face of the flange 16. Next, as shown in FIG. 7, the extending protrusions 19 of the waterproofing ring 18 are housed in the rectangular areas 17A of the housing groove 17, while the remainder of the inner circumference face of the waterproofing ring 18 fits tightly against the entire circumference of the side face of the housing 10.

Next, the alignment plate 15 is attached to the housing 10. The alignment plate 15 is positioned below the housing 10 in FIG. 1, the base end terminals 14A of the housing 10 are inserted through the attachment hole groups 24 provided on the alignment plate 15, and the alignment plate 15 is moved towards the housing 10 along the terminals 14. There is no interference between the alignment plate 15 and the waterproofing ring 18 at this juncture due to the clearance C (see FIG. 2) provided between the tip of the alignment plate 15 an the waterproofing ring 18 housed in the housing groove 17.

Figure 6:
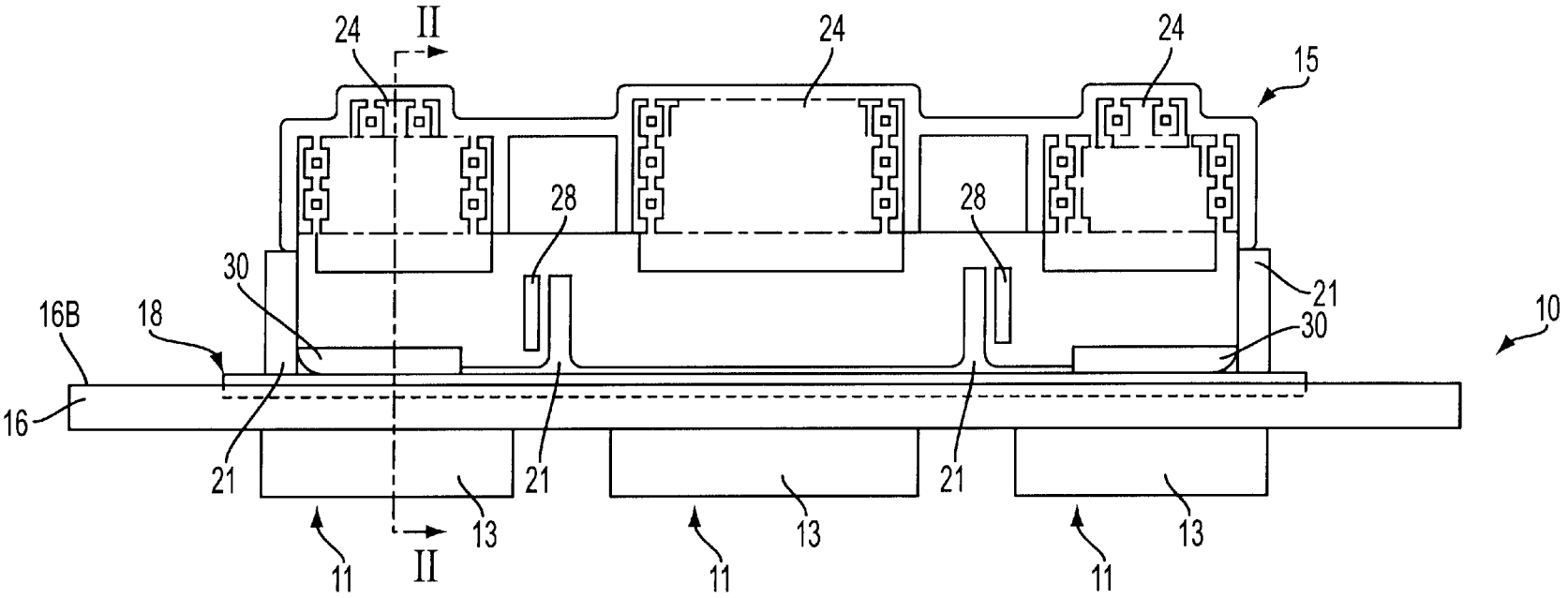
FIG. 6 is a view from below of the connector attached to a panel with an alignment plate in an attached state.

When the alignment plate 15 is pushed into the attachment face 20 of the housing 10, the installation protrusions 25 of the alignment plate 15 are housed between the ribs 21 provided on the attachment face 20 (see FIG. 6). At this juncture, the position fixing protrusion 26 provided on the alignment plate 15 (see FIG. 7) fits into the hole 27 provided on the housing 10 (see FIG. 7), thereby fixing the position of the alignment plate 15. Furthermore, the protruding members 29 (see FIG. 7) provided on the ribs 21 of the attachment face 20 cause the side walls of the installation protrusions 25B to change shape on the sides provided with the rectangular holes 28 (see FIG. 1). Consequently, the protruding members 29 and the side walls of the installation protrusions 25 press mutually against one another, thereby retaining the alignment plate 15 within the housing 10 by frictional force. Thereupon, as shown in FIG. 2, the vertical wall 30 provided in the alignment plate 15 and the extending protrusions 19 provided on the waterproofing ring 18 are in a state whereby they face each other.

The connector of the present embodiment is attached to the panel 32 (see FIG. 3) as follows: the base end terminals 14A maintained in the alignment plate 15 are inserted from their tips into the connector attachment hole 33 of the panel 32, the housing 10 being lifted along the bent portion of the base end terminals 14A and moved to the innermost portion of the connector attachment hole 33. At this juncture, since the vertical wall 30 on the alignment plate 15 and the extending protrusion 19 on the waterproofing ring 18 are in a state whereby they make contact with each other, the movement of the waterproofing ring 18 is regulated even if the rear face of the flange 16 faces downwards while the connector is being manipulated. Consequently, the waterproofing ring 18 will not slip off the housing 10. Then, the rear face of the flange 16 is pushed into the end portion of the connector attachment hole 33, bolts are passed through onto the end portion of the connector attachment hole 33, bolts are passed through the holes 16*a* on the flange 16 and holes (not shown) provided on the panel 32, and nuts are threaded onto the tips of the bolts. The lips 18A of the waterproofing ring 18 are squashed down by the flange 16 being pushed onto the panel 32, and form waterproofing faces along the circumference edge portions of the connector attachment hole 33. The attachment of the connector to the panel 32 is thereby completed.

In the attached connector of this embodiment, the waterproofing ring 18 cannot be separated and, consequently, the connector can be attached efficiently to the panel 32. Moreover, since the alignment plate 15 is used to control the position of the base end terminals 14A and thereby prevents the waterproofing ring 18 from separating, production costs are not high.

Furthermore, the present invention is not limited to the embodiments described above with the aid of figures. For example, the possibilities described below also lie within the technical range of the present invention. In addition, the present invention may be embodied in various other ways without deviating from the scope thereof.

(1) The top of the alignment plate 15 of the present embodiment is provided with a wall 30. However, it is equally possible that no wall be provided, and that the waterproofing ring simply faces the alignment plate. However, if the present embodiment is configured as described above, that is, the wall 30 provided on the alignment plate faces the extending protrusions 19 on the waterproofing ring 18, the area of contact of these two portions is greater, and the movement of the waterproofing ring 18 can therefor be regulated reliably.

(2) Further, the extending protrusions 19 (extending member) of the present embodiment form a pair. However, the extending member may equally well form, for example, a continuous extending protrusion extending along the entire inner circumference of the waterproofing ring 18. In such a case, the waterproofing ring 18 would be symmetrical both above and below, and it could be attached to the housing with a greater degree of freedom.

What is claimed is:

1. An electrical panel connector assembly for insertion in an aperture of a panel, and comprising a connector housing having a front side, a rear side, and a continuous peripheral flange adapted to contact a panel to limit the insertion depth of the housing into the panel, an annular seal adapted to be positioned against a rear side of the flange and having an inwardly extending protrusion in a plane of the seal, terminals protruding in a rearward direction from the rear side of the housing and having free ends which are bent substantially at right angles to the rearward direction, and an alignment plate attachable to a rear portion of the housing and having an alignment portion extending in the rearward direction and an abutment portion opposite to and facing the rear side of the flange, said alignment portion having apertures to receive said free ends of the terminals, and said abutment portion being in close proximity with a small clearance to said annular seal to prevent unwanted removal of the seal from the flange.

2. An assembly according to claim 1 wherein said abutment portion of the alignment plate has a projection extending outwardly and parallel to said flange in the vicinity of said protrusion.

3. An assembly according to claim 1 wherein said seal is provided with a plurality of said protrusions.

4. An assembly according to claim 3 wherein said seal is rectangular, and two of said protrusions are provided on a long side of said seal, one each of said protrusions being adjacent a respective short side of said seal.

5. An assembly according to claim 3 wherein said protrusions are accommodated between said flange and alignment plate with a clearance.

6. An assembly according to claim 1 wherein the seal has an annular sealing portion, the sealing portion and protrusion each have a thickness, and the thickness of said protrusion is less than the thickness of the annular sealing portion of said seal.

7. An assembly according to claim 1 wherein said seal is accommodated in a recess of said flange.

8. An assembly according to claim 1 wherein said annular seal has continuous lips on opposite sides thereof.

* * * * *